US005407077A

United States Patent [19]

Sinclair, Sr

[11] Patent Number: 5,407,077

[45] Date of Patent: Apr. 18, 1995

[54] CUSHION PACKAGING FOR HAZARDOUS LIQUIDS

[76] Inventor: Robert Sinclair, Sr, 2056 N. Ballas Rd., Des Peres, Mo.

[21] Appl. No.: 194,497

[22] Filed: Feb. 10, 1994

[51] Int. Cl.[6] ..... B65D 81/10; B65D 85/20

[52] U.S. Cl. ..... 206/586; 206/446; 206/588

[58] Field of Search ..... 206/446, 521, 523, 586, 206/588, 591, 592, 594; 250/506.1

[56] References Cited

U.S. PATENT DOCUMENTS

| | | | |
|---|---|---|---|
| 2,553,418 | 5/1951 | Loth | 206/591 X |
| 2,646,165 | 7/1953 | Whitehead | 206/592 |
| 3,339,821 | 9/1967 | Wojcik | 206/446 X |
| 3,963,171 | 6/1976 | Lindsay . | |
| 4,019,672 | 4/1977 | Giannini | 206/592 |
| 4,314,640 | 2/1982 | Manizza . | |
| 4,560,069 | 12/1985 | Simon | 206/591 |
| 5,193,705 | 3/1993 | McCallum et al. . | |

*Primary Examiner*—Bryon P Gehman

*Attorney, Agent, or Firm*—Polster, Lieder, Woodruff & Lucchesi

[57] ABSTRACT

Packaging is provided for canisters of hazardous materials. The packaging includes a box and identical upper and lower cushions which isolate the canister within the box so that the canister is spaced from the walls of the box and prevented from moving within the box. The cushions include outer, middle, and inner portions which are hinged together to define three layers. The middle and inner portions each have a hole formed in the center thereof. The inner portion hole is slightly larger than the middle portion hole to accommodate lock rings which are used to maintain the canister lid closed. In one embodiment, the middle and inner portions each define knockouts which may be removed to enlarge the size of the respective holes. This allows for a single cushion to selectively be used with one of at least two canister sizes.

20 Claims, 2 Drawing Sheets

CUSHION PACKAGING FOR HAZARDOUS LIQUIDS

BACKGROUND OF THE APPLICATION

This invention relates to packaging for paints, and in particular to packaging of flammable paints, such as petroleum based paints, and other Group 2 and 3 hazardous materials.

Flammable paints are categorized as Group 2 and 3 hazardous materials by the Department of Transportation (DOT). The DOT therefore regulates the transportation of such liquids. These regulations require that the packaging in which the liquids are transported or shipped meet certain conditions. More recently, the United Nations has also begun to regulate the shipment of industrial materials, including such items as petroleum paints.

SUMMARY OF THE INVENTION

One object of this invention is to provide packaging for petroleum based paints and other Group 2 and 3 hazardous materials.

Another object is the provision of such packaging which satisfies DOT and United Nations regulations.

Another object is the provision of such packaging which isolates, and prevents movement of, a can of liquid within a shipping box.

These and other objects will become apparent to those skilled in the art in light of the following disclosure and accompanying drawings.

In accordance with the invention, generally stated, packaging is provided for canisters of hazardous materials, such as flammable paint or other Group 2 and 3 hazardous materials. The canisters include a top, bottom and side walls. The top is removable, and for shipping, is closed with a ring lock. The packaging includes a box having a top, bottom, and side walls, a lower cushion which receives the bottom of the canister, and an upper cushion which receives the top of the canister. The upper and lower cushions are identical and serve to isolate the canister within the box so that the canister wall is spaced from the box side walls and so that the canister cannot move within the box relative to the box itself.

The upper and lower cushions each include an outer portion, adjacent a top or bottom of the box, a middle portion hingedly connected to the outer portion, and an inner portion hingedly connected to the middle portion. The middle portion has a hole formed centrally therein sized to receive the bottom of said canister. The inner portion has a hole concentric with the middle portion hole sized to receive the canister top and lock ring. The lock ring extends radially from the canister. The inner portion hole is thus larger than the middle portion hole to accommodate the lock ring. The middle and inner portion holes define a shoulder which rests on the lock ring. The cushions are made from 275 lb double corrugated paper board.

The cushion bottom portion includes tabs extending outwardly from edges thereof. The middle and inner portions include slots at their edges which are vertically aligned with the tabs. The tabs include an arm which extends up through the middle and inner portion slots and a finger which extends over the inner portion surface to hold the cushion in its folded position.

In accordance with one aspect of the invention, the cushions can be made to be selectively used with one of at least two different sized canisters. A perforated line is formed concentrically with the middle and inner portion holes. The area within the perforated lines defines a punch out which may be removed to increase the size of the holes. By increasing the size of the holes, the cushion can be used with differing sized canisters.

BRIEF DESCRIPTION OF THE DRAWINGS

Similar reference numerals denote similar parts throughout the various views of the drawings.

DESCRIPTION OF THE PREFERRED EMBODIMENT

Figure 1:
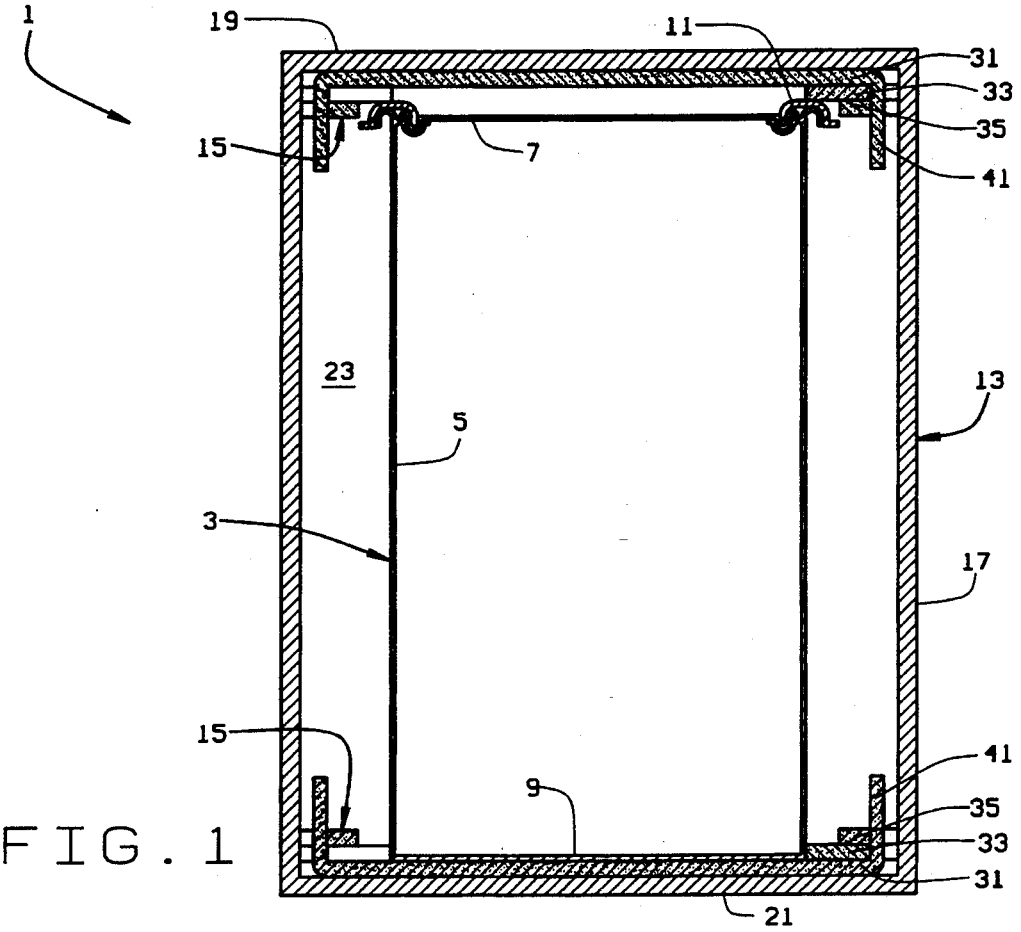
FIG. 1 is a cross-sectional view of a can of liquid contained in packaging formed in accordance with the present invention.

Turning to FIG. 1, packaging 1 of the present invention contains a can 3 of liquid, such as petroleum based paint. Although the packaging 1 is described for use with petroleum based paint, it could be used for other Group 2 or 3 hazardous materials. And, although the packaging is designed for, and has been certified for use with such materials, it can be used with other containers. Can 3 includes a cylindrical side wall 5, a top 7, and a bottom 9 defining a volume which can hold the desired liquid. The top 7 is removable to access the liquid inside. However, for purposes of shipping or transporting the can 3, the top is held closed by a ring lock 11, such as an Armstrong ring made and sold by Armstrong Containers, Inc. of Westchester, Ill., and which shown and described in U.S. Pat. No. 5,193,705, which is incorporated herein by reference.

Packaging 1 includes a box 13 and two cushioning elements 15. Box 13 has sides 17, a top 19, and a bottom 21 defining a space or volume 23 which is sized to hold the can 3. Bottom 21 is preferably sealed closed. The top 19, however, is openable so that the can 3 of paint and the cushions 15 can be placed inside. The two cushioning elements 15 are identical. One is placed at the bottom of the box to snugly brace or receive the bottom 9 of the can 3. The other cushion 15 is placed at the top of the box and receives the top of the can 3 and lock ring 11. Box 13 and elements 15 are sized and shaped so that the box snugly receives elements 15 to prevent movement of the cushions 15, and hence movement of can 3, in the box during shipping. Preferably, the box 13 and cushion 15 are both rectangular in top plan. Preferably, they are both square. The box 13 is also preferably rectangular in side elevation. Further, the box has an internal or effective height such that the can 3 cannot move vertically within the packaging 1. Cushions 15 further isolate can 3 in the box so that the sides 5 of the can 3 are spaced inwardly from the walls 17 of the box. As can be appreciated, packaging 1 isolates can 3 in box 13 so that can 3 cannot come into contact with any other can which is part of the same shipment and prevents any movement of the can within the packagings. The fact that the box 13 is rectangular also facilitates arranging boxes 13 in a shipment. Because they are rectangular, the boxes will be adjacent each other along all their faces, and they will brace each other. Thus, the boxes will not be able to move relative to each other and the cans of paint will be further stabilized within the transporter. Although the box 13 and cushion 15 could be made to be circular in plan, a circular packaging may not achieve the same effect of preventing movement of one box relative to another in a large shipment.

Figure 2:
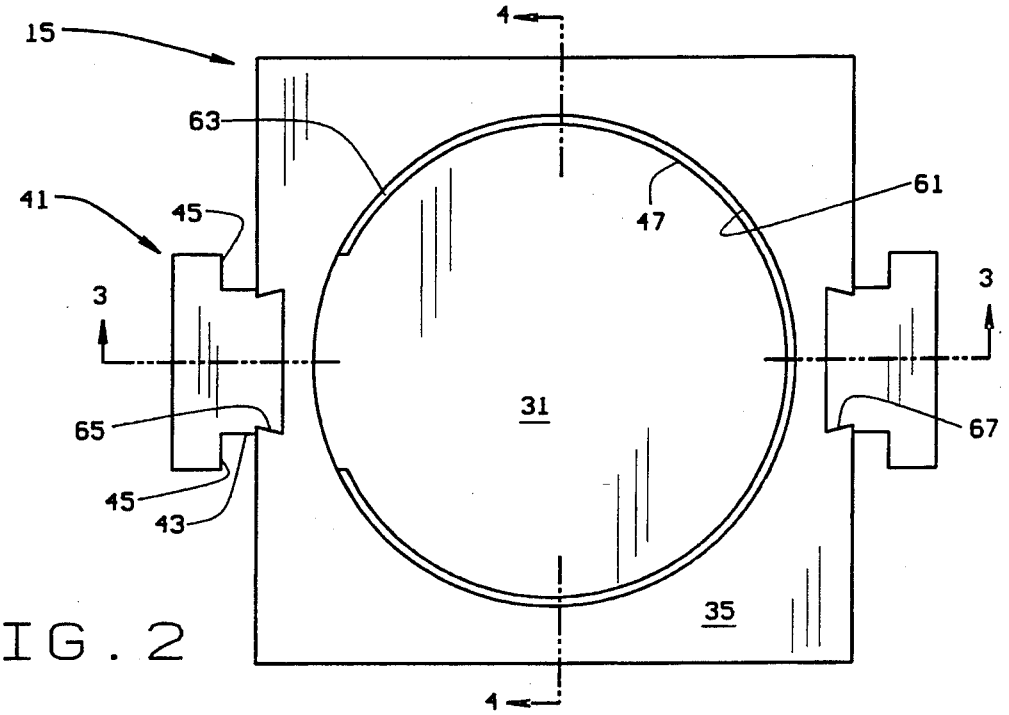
FIG. 2 is a plan view of a cushioning element of the packaging.
Figure 3:
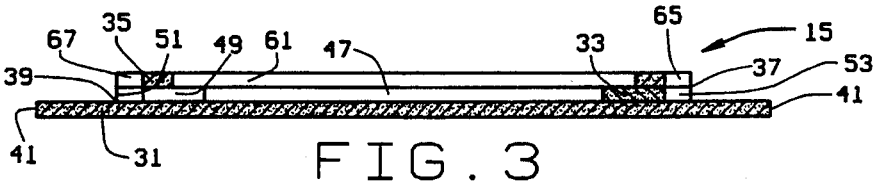
FIG. 3 is a cross-sectional view of a cushioning element of the packaging taken along line 3—3 of FIG. 2.
Figure 4:
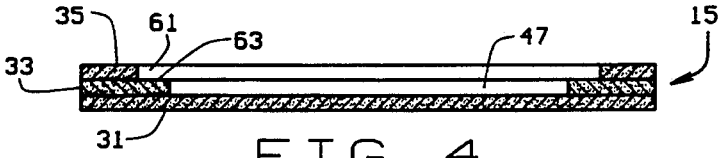
FIG. 4 is a cross-sectional view of the cushioning element taken along line 4—4 of FIG. 2.

Cushion 15, best shown in FIGS. 2–4, is made of paperboard. Preferably, the paper board is double-walled corrugated board. Paperboard having a basis weight of 275 lbs. has been found to meet both the DOT and United Nations regulations. Each cushion 15 includes three portions: an outer portion 31, a middle portion 33, and an inner portion 35 which are hinged together as at 37 and 39. The outer portion 31 is solid and defines a pair of tabs 41 at opposed sides thereof. Tabs 41 have an arms 43 which extend from an edge of outer portion 31 and a finger 45 extending generally perpendicularly from arm 43. Preferably there are two fingers 45 giving the tab 41 a generally overall T-shape.

Middle portion 33 has an opening 47 formed therein sized to snugly receive the bottom 9 of paint can 3. For example, for a standard one quart paint can, opening 47 has a radius of about 4¼". Opening 47 is circular and is centered with respect to the edges of cushion 15. A slot 49 is formed at an edge 51 of portion 33 which forms hinge 39. Slot 49, as will be explained below, is preferably complimentary shaped to tab 41 and intersects with or communicates with opening 47. The edge of opening 47 is thus not complete. A second slot 53 is formed along the opposite edge 55 of middle portion 33 and is spaced from opening 47. Slots 49 and 53 are positioned at opposite edges of middle portion 33 to be vertically aligned with tabs 41 when the cushion is assembled.

Inner portion 35 has a circular opening 61 formed centrally thereof and coaxial with middle portion opening 47. Opening 61 larger than middle portion opening 47 so that the middle and top portions cooperate to form a shelf or shoulder 63. Opening 61 is sized to snugly receive the paint can top 7 with the lock ring 11 in place thereabout. For example, for a standard one quart can of paint closed with ring lock 11, the opening 61 has a radius of about 4½". Like middle portion 33, top portion 35 has two slots 65 and 67 formed at opposite edges thereof. Slot 65 is formed at edge 69 which defines the hinge 37 between the middle and top portions. Slot 65 is formed to be aligned with middle portion slot 53. Slot 67 is formed at edge 71 to be aligned with middle portion slot 49. The slots 65 and 67 are thus also vertically aligned with tabs 41 when the cushion 15 is assembled.

Figure 5:
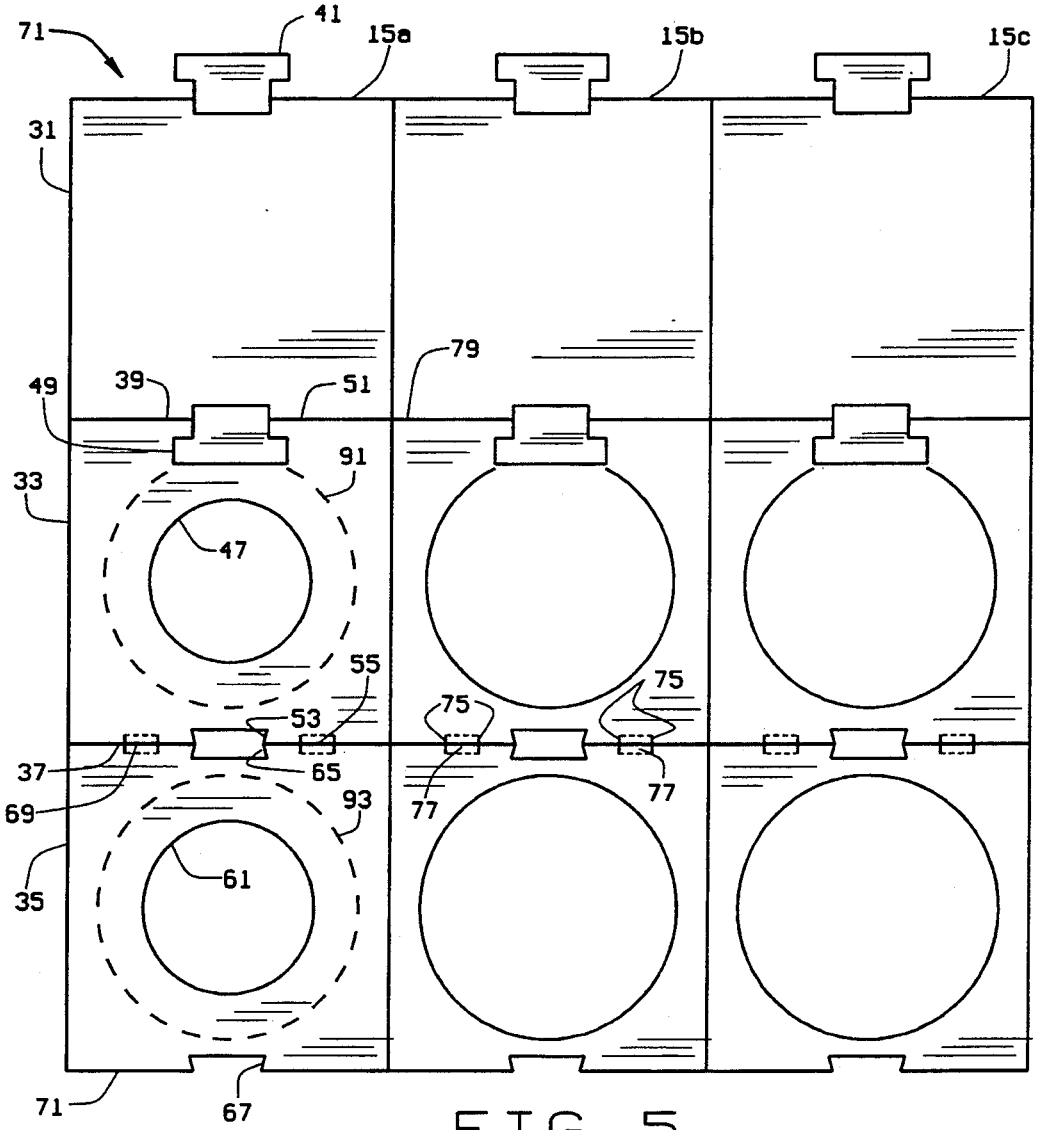
FIG. 5 is a plan view of a blank used to form the cushioning element.

Turning to FIG. 5, a blank 73 is shown from which cushions 15 are formed. Blank 73 has a length at least equal to the length of the three portions 31, 33 and 35 when laid out. The blank may be sized to form multiple cushions at once. The blank 73 shown can form three cushions 15*a*, 15*b* and 15*c*. The cushions 15*a–c* are adjacent the sides of each other. However, the blank could be sized to form cushions one atop the other, i.e. the top edge of portion 31 of cushion 15*a* would form the bottom edge of cushion 15*b*. Stated differently, the cushions could be formed in matrices such as 2×2, 2×3, etc., as well as the 1×3 matrix shown in FIG. 5.

The blank 17 is scored to form the hinges 37 and 39. One score is a hinge score which includes a slot score 74 extending across the width of the cushion which is interrupted by a pair of slot scores 75 generally perpendicular to score 74 to define hinges 77. The other score is a slit score 79. This will allow the blank to be cut from one side. One of the tabs 41 is formed along an end or top edge (as seen in FIG. 5) and the other is cut along the score line 79 which forms hinge 39. The cut which forms the second tab 41 also forms the slot 49 for the middle portion 33. The blank 73 is preferably die cut and thus the scores, holes and tabs are all cut at once.

Once cut and separated from each other, the cushions 15 are assembled by folding the inner 35 and outer 31 portions over opposite sides of the middle portion 33. The tabs 41 are bent from the outer portion 31 towards inner portion 35 to be received in the slots 49, 53, 65, and 67 formed in the edges of the middle and inner portions. The arms 43 of the tabs are of a length sufficient to extend through the two portions of the cushion so that the fingers 45 of the tab extend out over the exposed surface of the inner portion 35. The tabs 41 therefore help to hold the cushion together while the packaging is being assembled.

In use, two cushions 15 are used with each box 13 to form packaging 1. One cushion is placed at the bottom of the box with the openings 47 and 61 facing upwardly. The can 3 is placed in the box 13 so that the bottom of the can is fitted within opening 47 and rests on the cushion's outer portion 31. The second cushion 15 is then placed over the top of the can so that the lock ring 11 is received within opening 61 of the cushion's inner portion 35 so that shoulder 63 rests on top of ring 11. The top of the box is then closed and sealed shut. As explained above, the box is sized so that the inner surface of the box top will be adjacent the lower, or outer, surface 31 of cushion 15. The can bottom is spaced from the box bottom by the width of the cushion outer portion and the can top is spaced from the box top by the width of the cushion middle 33 and outer 31 portions. The box height (from the inside) is thus equal to the height of the paint can with the lock ring 11 in place plus the height of one cushion 15.

As shown if FIG. 5, the cushions 15 can be formed so that they can be selectively used with two different sized cans, for example one quart cans or one gallon cans. The cushions 15 shown in FIG. 5 have second outer openings defined by lines 91 and 93 in the middle and inner portions 33 and 35, respectively. Lines 91 and 93 are perforated lines so that the material contained within the lines may be punched out so that the cushion may be used with the larger sized can. Of course, once the openings have been enlarged, the cushion 15 can only be used with the larger sized can.

Variations within the scope of the appended claims may be apparent to those skilled in the art. For example, the cushions can be made of another type of paper board. If smaller cans are to be shipped, lighter weight paperboard may be used. If much heavier cans are to be shipped, heavier paperboard may be used. The cushions may be made with more than three portions. This would give the cushions greater ability to prevent horizontal motion of the can relative to the box. If more portions were to be used, the forth and later portions would have openings equal in size to the opening 61 of the upper or inner portion 35. The cushions may be made using only one tab to hold the cushion together. The tab could be placed along any of the four edges of the cushion. Alternately four tabs may be used. Although the portions are linearly arranged in the blank, they could be arranged in an L-shape. These examples are merely illustrative.

I claim:

1. Packaging of a canister of liquid, the canister having a top, a bottom and a side wall; the packaging including a box having a top, bottom, and side walls defining an area sized and shaped to receive said canister, a foldable lower cushion which receives the bottom of the canister, and a foldable upper cushion which receives the top of the canister, the upper and lower cushions isolating the canister within the box so that the canister side wall is spaced from the box side walls; the upper and lower cushions being identical; each said cushion including:

a cushion outer portion adjacent one of a top or bottom of the box and including a tab extending outwardly from an edge of said outer portion;

a cushion middle portion hingedly connected to said outer portion, said middle portion including a hole formed centrally therein sized to receive the bottom of said canister and a slot vertically aligned with said tab when said cushion is folded; and a cushion inner portion hingedly connected to said middle portion to fold over said middle portion so that it is separated from said outer portion by said middle portion, said inner portion including a hole sized to receive the canister top and a slot, the inner portion slot being vertically aligned with the middle portion slot and tab and the inner portion hole being vertically aligned with the middle portion hole when said cushion is folded;

the middle and inner portion slots receiving said tab to secure said cushion portions together.

2. The packaging of claim 1 wherein said canister top is locked to said canister by a lock ring, said inner portion hole having a diameter slightly greater than said middle portion hole, said middle and inner portions cooperating to define a shoulder, said shoulder of said upper cushion resting on top of said lock ring.

3. The packaging of claim 2 wherein said canister bottom is spaced from the box bottom by said cushion outer portion and the canister top is spaced from the box top by a distance equal to the combined thickness of said cushion middle and outer portions.

4. The packaging of claim 2 wherein said cushion outer portion includes a second tab, said middle and inner portions including second slots vertically aligned with said second tab.

5. The packaging of claim 4 wherein said first and second tabs are formed at opposite edges of each said cushion.

6. The packaging of claim 4 wherein said tabs include an arm extending outwardly from said outer portion and a finger extending generally perpendicularly to said arm at an end of said arm distal from said outer portion, said finger extending over a surface of said inner portion.

7. The packaging of claim 6 wherein said tabs include two fingers, said fingers and said arm defining a T-shape.

8. The packaging of claim 1 wherein each said cushion is made of double walled paperboard.

9. The packaging of claim 8 wherein said paperboard has a weight basis of 275 lbs.

10. The packaging of claim 1 wherein said inner and outer portions are hinged to opposite sides of said middle portion.

11. The packaging of claim 10 wherein the middle portion slots are located on hinge edges of said middle portion.

12. The packaging of claim 1 wherein each said cushion can be selectively used for at least two different sized canisters.

13. The packaging of claim 12 wherein each said cushion includes at least one perforated line concentrically formed with said middle and inner openings, said at least one perforated line defining a punch out which may be selectively removed to accommodate larger canisters.

14. Packaging of a canister of liquid, the canister having a removable top, a bottom and side walls, the canister removable top being secured with a lock ring; the packaging including a box having a top, bottom, and side walls defining an area sized and shaped to receive said canister, a foldable lower cushion which receives the bottom of the canister, and a foldable upper cushion which receives the top of the canister, the upper and lower cushions isolating the canister within the box so that the canister wall is spaced from the box side walls; the upper and lower cushions being identical; each said cushion including:

a cushion outer portion adjacent one of the top or bottom of the box;

a cushion middle portion hingedly connected to said outer portion and including a hole formed centrally therein sized to receive the bottom of said canister;

a cushion inner portion hingedly connected to said middle portion to fold over said middle portion so that it is separated from said outer portion by said middle portion, said inner portion including a hole sized to receive the canister top and lock ring, the inner portion hole being vertically aligned and coaxial with the middle portion hole when said cushion is folded, the inner portion hole having a diameter larger than the middle portion hole, said middle and inner portions cooperating to define a shoulder which rests on said lock ring; and sizing means for allowing a packer to selectively use said cushions with one of at least two canister sizes.

15. The packaging of claim 14 wherein said sizing means includes at least one perforated circular line concentrically formed with each of said middle and inner openings, said at least one perforated line defining a punch-out out which may be selectively removed to accommodate larger canisters.

16. The packaging of claim 15 wherein the canister bottom is spaced from the box bottom by said cushion outer portion and the canister top is spaced from the box top by a distance equal to the combined thickness of said cushion middle and outer portions.

17. The packaging of claim 16 wherein each said cushion includes locking means for securing said portions together.

18. The packaging of claim 17 wherein the cushion locking means includes at least one tab extending outwardly from an edge of said outer portion and at least one slot defined by each of said middle and inner portions, the middle and inner portion slots being vertically aligned with said at least one tab, said at least one tab including an arm which extends through said slots and a finger which extends over a surface of said inner portion to lock said cushion together.

19. The packaging of claim 18 wherein each said cushion is made of 275 lb basis weight double-walled paperboard.

20. Packaging of a canister of liquid, the canister having a removable top, a bottom, and a side wall, the canister removable top being secured with a lock ring;

the packaging including a box having a top, bottom, and side walls defining an area sized and shaped to receive said canister, a lower cushion which receives the bottom of the canister, and an upper cushion which receives the top of the canister, the upper and lower cushions isolating the canister within the box so that the canister side wall is spaced from the box side walls; the upper and lower cushions being identical; each said cushion including:

a cushion first portion adjacent one of a top or bottom of the box; and a cushion second portion, said second portion including a hole formed centrally therein sized to receive the bottom of said canister and a perforated circular line concentrically formed with said second portion hole, said perforated circular line defining a punch-out area sized to accommodate the lock ring which surrounds the canister top.

* * * * *